United States Patent [19]

Sontag

[11] 4,233,326

[45] Nov. 11, 1980

[54] PACKAGE FOR INDIVIDUALLY WRAPPED STRIP-SHAPED PIECES OF CHEWABLE AND EDIBLE ARTICLES

[76] Inventor: Klaus A. Sontag, Überseering 25, 2000 Hamburg 60, Fed. Rep. of Germany

[21] Appl. No.: 4,584

[22] Filed: Jan. 18, 1979

Related U.S. Application Data

[63] Continuation-in-part of Ser. No. 855,930, Nov. 29, 1977, abandoned.

[30] Foreign Application Priority Data

Nov. 30, 1976 [DE] Fed. Rep. of Germany ..... 2654179
May 26, 1978 [DE] Fed. Rep. of Germany ... 7815738[U]

[51] Int. Cl.[2] ..... B65D 85/62; B65D 83/08; B65D 75/32

[52] U.S. Cl. ..... 426/115; 206/526; 206/800; 206/820; 206/472; 40/492; 426/119; 426/123

[58] Field of Search ..... 426/108, 115, 119, 123; 206/800, 554, 472, 806, 466, 425, 39, 39.6, 526, 820; 229/69; 40/492; 402/500

[56] References Cited

U.S. PATENT DOCUMENTS

| | | | |
|---|---|---|---|
| 16,829 | 3/1857 | French | 150/28 R |
| 366,510 | 7/1887 | Rubin | 40/492 |
| 485,967 | 11/1892 | Mosher et al. | 40/492 |
| 921,822 | 5/1909 | Gaul | 206/312 |
| 924,929 | 6/1909 | Pemberton | 229/69 |
| 1,063,577 | 6/1913 | Moran | 40/492 |
| 1,142,021 | 6/1915 | Chambers | 402/500 |
| 1,469,573 | 10/1923 | Aberle | 402/500 |
| 1,666,006 | 4/1928 | Duncan | 206/39 |
| 2,289,028 | 7/1942 | Manko | 426/108 |
| 2,681,677 | 6/1954 | Poeltl | 150/39 |
| 2,904,900 | 9/1959 | Kramer | 402/500 X |
| 3,542,191 | 11/1970 | Scott | 426/108 |
| 3,685,717 | 8/1972 | Seiferth et al. | 426/108 |
| 3,924,009 | 12/1975 | Goldberg et al. | 426/115 |
| 3,950,871 | 4/1976 | Rege | 40/492 |
| 4,070,775 | 1/1978 | Brooks | 40/492 |

FOREIGN PATENT DOCUMENTS

| | | | |
|---|---|---|---|
| 2500100 | 7/1976 | Fed. Rep. of Germany | 426/120 |
| 2654179 | 6/1978 | Fed. Rep. of Germany | 206/DIG. 800 |
| 549944 | 4/1922 | France | 40/492 |
| 1480373 | 4/1967 | France | 206/493 |
| 83310 | 11/1919 | Switzerland | 206/820 |
| 338513 | 11/1930 | United Kingdom | 206/820 |
| 349672 | 6/1931 | United Kingdom | 206/425 |

*Primary Examiner*—Steven L. Weinstein
*Attorney, Agent, or Firm*—Becker & Becker

[57] ABSTRACT

A package for strips of chewing gum, sweets, food, and other chewable and edible articles which are wrapped individually into flat packets arranged one above the other. Each of the packets at one end thereof is provided with an extension projecting in the longitudinal direction of the packet and beyond the content of the packet. Each extension has a hole therethrough through which extends a common pivot member which at its ends has a head or the like to keep the packets on the pivot member while all of the packets are pivotable about the common pivot member.

3 Claims, 7 Drawing Figures

PACKAGE FOR INDIVIDUALLY WRAPPED STRIP-SHAPED PIECES OF CHEWABLE AND EDIBLE ARTICLES

This is a continuation-in-part application of parent case Ser. No. 855,930-Sontag filed Nov. 29, 1977, now abandoned.

The present invention relates to a package for individually wrapped strip-shaped pieces of chewing gum, sweets, food, and other goods for human consumption.

By "package" is meant a packet or combination of substantially identical basic packets which in their turn contain the chewing gum or the like for the immediate consumption.

The above mentioned strips of chewing gum or the like are arranged in packets one located above the other. When the wrapping paper is opened at one end and removed, the individual strips of chewing gum can be pulled out of the package one after the other. With this kind of layering, however, it is possible only under difficulties to take out a certain desired packet of the individually wrapped strips of chewing gum from a number of different kinds of gum in the package. This known arrangement further makes it impossible to offer the prospective user a selection of the different packets in such a way that he can immediately pick out the chewing gum of a desired flavor and can remove the respective packet from the package.

Therefore, it is an object of the present invention so to improve the packaging of the individual packets that the user can at a glance distinguish between the various packets and can pull out the desired one without disturbing the packaging for the remaining packets.

This object and other objects and advantages of the invention will appear more clearly from the following specification in connection with the accompanying drawing, in which.

Figure 1:
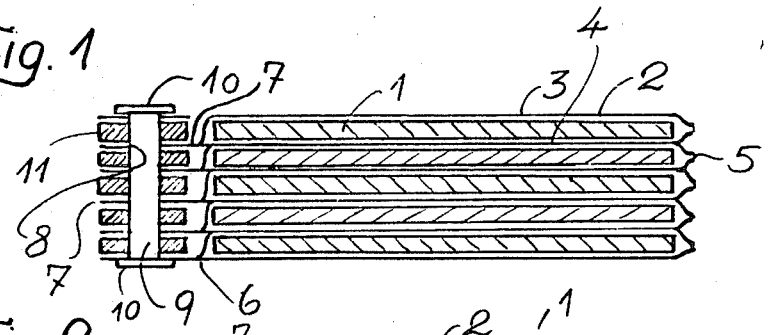
FIG. 1 represents a longitudinal section through a plurality of chewing gum packets located one above the other and arranged in conformity with the present invention.
Figure 3:
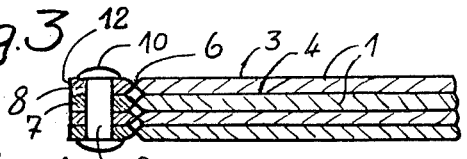
Figure 4:
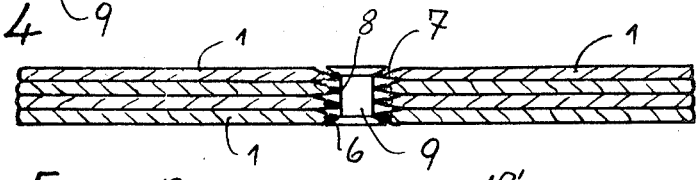
Figure 5:
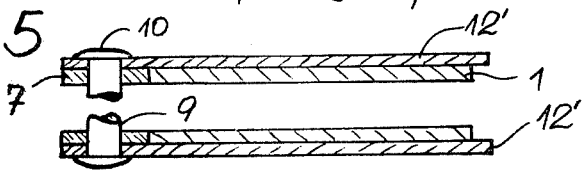

FIGS. 3, 4 and 5 respectively illustrate three different modifications of the package according to FIG. 1.

Figure 6:
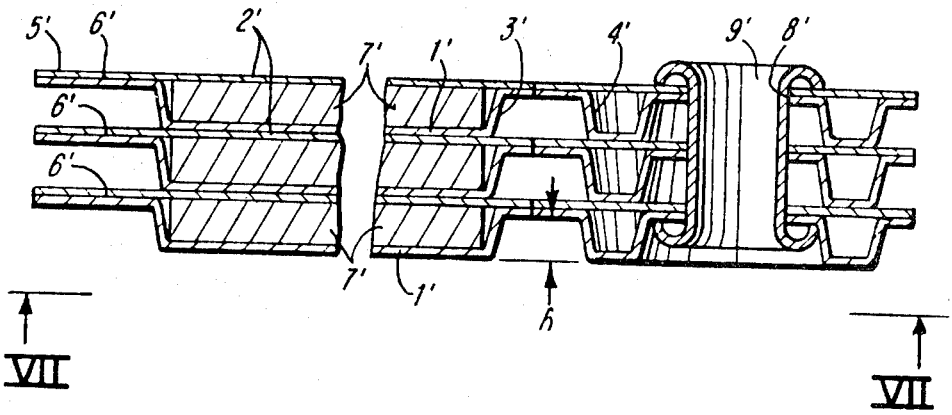

FIG. 6 shows a longitudinal section through yet another chewing gum package according to the present invention.

Figure 7:
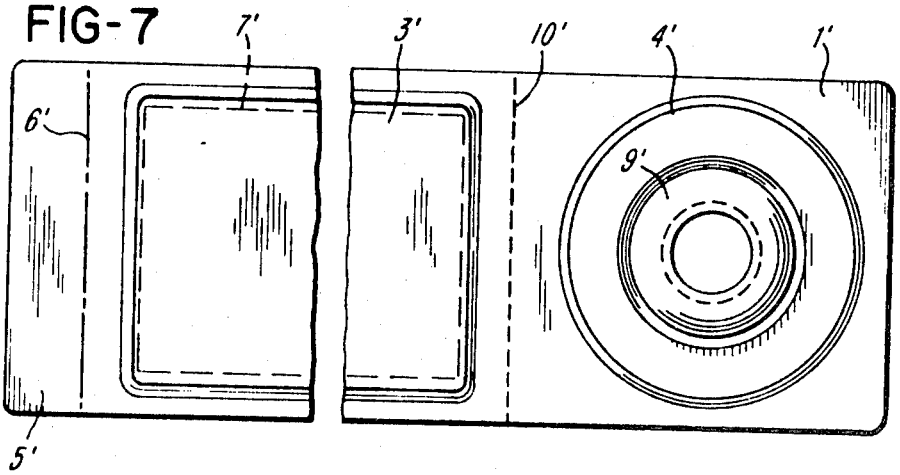

FIG. 7 shows the package of FIG. 6 as seen from below in the direction of arrow VII.

The package according to the present invention is characterized primarily in that the individual packets are provided with a hole or a perforation through which a pin or rivet or the like extends. The individual packets are pivotable about this pin or rivet.

Such an arrangement makes it possible to open and close the package in a fan-like manner so that after removal of a packet the remaining packets can be folded together to their original position. Preferably the pin or rivet or the like about which the individual packets are pivotable is located near one end of the package. It is, of course, also possible to place the pin, rivet or the like at another place, for instance, between two groups of packets. This means that a package would be located at each side of the pivot axis.

To be able to use the heretofore customary foils also for a package according to the present invention, it is possible, at the pivot axis, to provide filler pieces or members which can compensate for the wall thickness of the chewing gum strips or the like. Furthermore, each individual packet may in the vicinity of the pivot axis be provided with a perforation, indentation or the like which permits the user quickly to tear off or pull off any desired packet.

Figure 2:
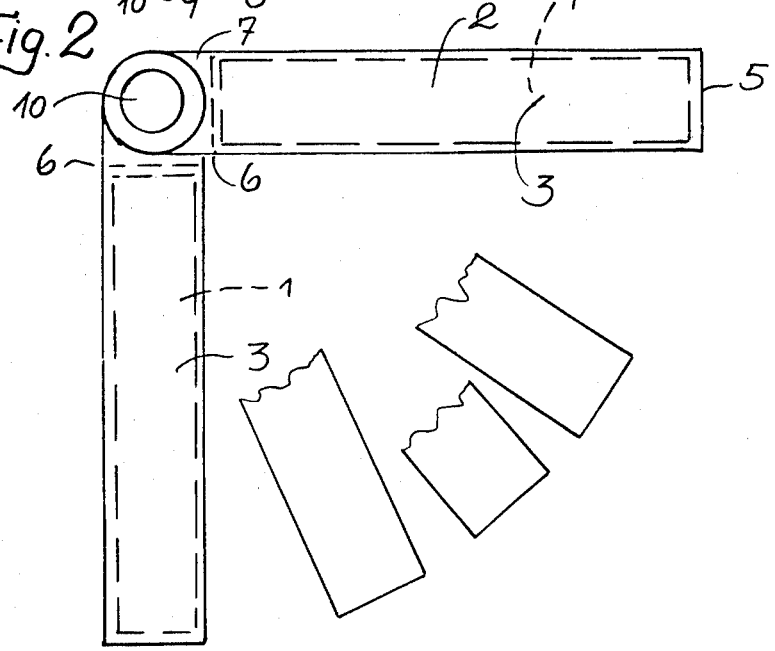
FIG. 2 is a top view of the package of FIG. 1 with the individual packets fanned-out.

Referring now to the drawings in detail, the chewing gum strips 1 have a flat rectangular cross section and a flat rectangular longitudinal section. With a length of about 70 mm and a width of about 20 mm the strip has a wall thickness of about 1.7 mm. The strips 1 are wrapped in a foil 2 in a manner known per se. The foil sections 3, 4' are at the free end of strip 1' fused at 5 and at the other end of strip 1 fused at 6. At 6 there may also be provided a separation line formed by perforations or indentations. The foil sections 3, 4 are extended beyond one end of the strip 1. The thus formed sections 7 consist according to FIGS. 1 and 2 of foil sections located directly one on top of the other. The section 7 of all packets is provided with a hole or perforation 8 through which extends a rivet-like pin 9 of synthetic material or the like. By means of the two heads 10 of the pin 9' all individual packets are held together. However, all individual packets can, as illustrated in FIG. 2, be individually pivoted about the pin 9 to thereby allow a quick spreading or fanning-out of the individual packets and a fast and easy removal of the selected packet. In order to be able to sufficiently compensate for the thickness of the strips 1, perforated or holed filler pieces 11 of synthetic material or the like are placed upon the pin 9 in such a way that the filler pieces 11 and the foil sections 3, 4 alternate.

By exerting a slight pull, the strips 1 with their pertaining wrapping can be separated from the package. This separation takes place at 6. Thus, the package remains intact even after the removal of some packets because those portions of the packets through which the pin 9 extends remain on the pin. Finally, there is left the pin axis 9 with the foil portions thereon through which it extends, and this can be discarded as waste.

The embodiment of FIG. 3, does not provide for filler members 11 as separate bodies. The filler members 12 used in this embodiment are enclosed by the two foil sections 3, 4.

According to FIG. 4, in each plane there are provided strips 1 arranged in aligned pairs and between these pairs of strips 1 there are located the sections 7 with the perforations 8. Also with this embodiment, a fan-like spreading out of the individual packets is possible and even a spreading out into the shape of a star can be effected.

The embodiment of FIG. 5 provides a cover layer 12' of suitable material, for instance a somewhat stronger foil than that used for wrapping the chewing gum, these cover layers 12' being provided at the top and at the bottom of the package and enclosing therebetween the strips 1 combined to a package. The covers 12' are likewise pivotally arranged on the pin 9 and have a top view corresponding to that of the individual packets.

It may also be mentioned that between the articulated individual packets there may be provided foils or plates which are likewise pivotally arranged and which may serve a special purpose. Thus, for instance, they can increase the stability of the package, they can improve the pivotability of the packets, and they may also serve for providing thereon advertisement or special instructions.

An additional innovation relates to the package for stripshaped chewing gum and the like, and in particularly to individually packaged components of this type.

With the known packages of this type, the individually packed pieces of chewing gum are arranged in layers, one above the other in a packet from which after removal of the top piece, the chewing gum can be withdrawn individually in sequence. Under such circumstances, it is not possible to select a particular chewing gum for instance a chewing gum of a particular flavor.

The object of the additional innovation is essentially to improve the heretofore known packages so that the consumer or user can readily make a selection from several types of chewing gum and can then remove the desired chewing gum without endangering the unity and stability of the package.

According to the present embodiment, the basic packets are press out packings which at one end are provided with one or more hollow chambers, the depth of which corresponds approximately to the remaining depressions serving for receiving the chewing gum and the like. Additionally, the press out packets, in the region of the additional hollow chambers, is provided with a hole having a shaft or axis extending therethrough holding together several press out packets and around which the individual basic packets are individually pivotable to the side so that, for example, all or a portion of the packings can be spread out in the manner of a fan.

This embodiment of the package makes possible not only the mentioned spreading out of the basic packets, but also permits a return pivoting into the starting position whereby the basic packets all lie one above the other again. In the spread or swung-out condition, the basic packets can be viewed, selected, and then removed. It is then possible to remove the empty packet by withdrawal or pulling off which can be facilitated by way of a perforation or the like.

The basic packet is advantageously so embodied that the additional depressions form the spacer pieces in the region of the pivot axis.

Further details of the innovation are set forth with reference to the package shown in FIGS. 6 and 7, which provides three basic packets for chewing gum; as a rule, however, still more basic packets are unified in a package.

Each basic packet consists of a lower foil 1' and an upper foil 2' covering the same. The foil 1' is kept thicker and stronger than the foil 2'. The foil 1' has a pan-shaped depression or recess 3' located particularly at one end of the basic packet. A ring-shaped depression 4' is connected to this depression 3' and the depression 4' forms the other end of the basic packet.

The foils 1' and 2' are connected with each other by hot sealing and the like in a known manner; accordingly, closed hollow chambers resuit as a consequence of the depressions or recesses 3', 4'. Both mentioned foils however, are not connected with each other at the free end of 5', thus forming a tearing-open flap or the like, making manual withdrawal of the upper foil 2' possible. This tearing-open flap 5' is approximately rectangular or squared and limited by the boundary represented by the dashed lines 6' (FIG. 7).

The chewing gum 7' to be packeted is located within the depression or recess 3'.

The ring-shaped depression or recess 4' surrounds a hole 8' having a hollow rivet or pin 9' forming an axis passing therethrough in such a manner that all basic packets arranged one above the other are held together yet are capable of being pivoted sequentially in a fan-like manner or individually toward the side for access thereto. As a result, the individual pieces of chewing gum 7' or the writing upon the foils 1', 2' pertaining thereto can be recognized and selected.

The desired chewing gum is then freed by withdrawal of the foil 2' or by being pushed out in the manner of known press out packets for removal of the chewing gum from the packaging. The depression or recess 3' with the foil 2' can then be separated along a separating or perforation line 10', in which connection the ring-shaped depression or recess 4' pertaining thereto remains with the covering part of the foil 2' on the hollow rivet or pin 9'. An important feature is that the depth "h" of both depressions or recesses 3', 4' are identical and in agreement with each other; accordingly, spacer bodies are formed by depressions or recesses 4', in other words in the region of the hollow rivet or pin 9', resulting in a layering, the height of which corresponds to that in the region of the actual package. Consequently, a satisfactory pivoting of the basic packets is made possible, even when a portion of the container formed by the depression or recess 3' and the foil segment (foil 3') pertaining thereto is removed for taking out a piece of chewing gum or chewable article content 7'.

The present invention concerns hermetically sealed or closed packets or packages which along one edge are provided with a tongue or flap segment 5' for pivotally journalling the packages. The packets or packages can be opened or destroyed for use of the contents thereof.

It is, of course, to be understood that the present invention is by no means limited to the specific showing in the drawings, but also encompasses any modifications within the scope of the appended claims.

What is claimed is:

1. A package having strips of chewing gum, sweets, food, and other chewable or edible articles held individually in relatively flat elongated closed packets arranged one above the other; each of said packets comprising a lower foil portion and a thinner upper foil portion substantially covering said lower foil portion; said lower foil portion having a pan shaped depression located at one end of the packet and a continuous closed depression enclosing an undepressed portion of said lower foil portion and located at the other end of said packet and connected to said pan shaped depression by another undepressed portion of the lower foil portion; said upper foil portion being sealed to the lower foil portion at the undepressed portions of the lower portion; the upper foil portions of each packet sealed over the pan shaped depression forming sealed chambers with said articles contained therein; the upper foil portion and the lower foil portion being unsealed at the edge of the packet adjacent the pan shaped depression thus forming a flap for tearing open the sealed chambers; said continuous depression surrounding a hole in the undepressed portion of said lower portion having a rivet or pin forming an axis passing therethrough with said rivet or pin including means so that all the packets are held together one above the other yet are capable of being pivoted selectively in a fan-like manner; said undepressed portion connecting the pan shaped depression and said continuous depression and the upper foil portion which overlies it being perforated for removal of the pan shaped depression from said continuous depression and said rivet or pin; the pan shaped depression and the continuous depression being of equal depth so that the continuous depressions act as spacer bodies along said rivet or pin so that satisfactory pivoting of the packets are possible even when a portion of the packet formed by the pan shaped depression and its overlying upper foil portion is removed.

2. A package according to claim 1, in which the continuous depression surrounds the hole in a ring-form located concentrically therewith.

3. A package according to claim 1, in which said rivet or pin is hollow.

* * * * *